US006467541B1

(12) United States Patent
Wells

(10) Patent No.: US 6,467,541 B1
(45) Date of Patent: Oct. 22, 2002

(54) PLUNGER LIFT METHOD AND APPARATUS

(76) Inventor: Edward A. Wells, 14862 Cabo de Bara, Corpus Christi, TX (US) 78418

( * ) Notice: Subject to any disclaimer, the term of this patent is extended or adjusted under 35 U.S.C. 154(b) by 0 days.

(21) Appl. No.: 09/630,255

(22) Filed: Aug. 1, 2000

Related U.S. Application Data

(63) Continuation-in-part of application No. 09/312,737, filed on May 14, 1999.

(51) Int. Cl.[7] ..... E21B 43/00
(52) U.S. Cl. ..... 166/153; 166/372
(58) Field of Search ..... 166/105, 153, 166/155, 193, 372; 417/58, 56

(56) References Cited

U.S. PATENT DOCUMENTS 2,074,912 A 3/1937 Hutto
3,090,316 A 5/1963 Montgomery
3,412,798 A * 11/1968 Gregston
4,211,279 A * 7/1980 Isaacks ..... 166/64
4,625,795 A * 12/1986 Despax et al. ..... 166/66
4,629,004 A * 12/1986 Griffin ..... 166/372
5,335,727 A * 8/1994 Cornette et al. ..... 166/278
5,414,227 A * 5/1995 Jennings ..... 166/278
6,045,335 A * 4/2000 Dinning ..... 417/59
6,148,923 A * 11/2000 Casey ..... 166/372
6,209,637 B1 * 4/2001 Wells ..... 166/153

* cited by examiner

*Primary Examiner*—William Neuder
*Assistant Examiner*—Jennifer Dougherty
(74) *Attorney, Agent, or Firm*—G. Turner Moller

(57) ABSTRACT

A plunger lift for a hydrocarbon well includes a multipart piston that is dropped into the well in separate pieces. When the pieces reach the bottom of the well, they fall into an accumulation of the formation liquid in the bottom of the well and unite. Gas from the formation pushes the unit upwardly, pushing liquid above the piston toward the surface. In one embodiment, the piston is made of a low density, high strength material such as silicon nitride and/or titanium alloys.

17 Claims, 2 Drawing Sheets

PLUNGER LIFT METHOD AND APPARATUS

This application is a continuation-in-part of application Ser. No. 09/312,737, filed May 14, 1999.

This invention relates to a plunger lift system for moving liquids upwardly in a hydrocarbon well.

BACKGROUND OF THE INVENTION

There are many different techniques for artificially lifting formation liquids from hydrocarbon wells. Reciprocating sucker rod pumps are the most commonly used in the oil field because they are the most cost effective, all things considered, over a wide variety of applications. Other types of artificial lift include electrically driven down hole pumps, hydraulic pumps, rotating rod pumps, free pistons or plunger lifts and several varieties of gas lift. These alternate types of artificial lift are more cost effective than sucker rod pumps in the niches or applications where they have become popular.

One of the developments that has evolved over the last thirty years are so-called tubingless completions in which a string of tubing, usually 2⅞" O.D., is cemented in the well bore and then used as the production string. Tubingless completions are never adopted where pumping a well is initially considered likely because sucker rod pumps have proved to be only slightly less than a disaster when used in a 2⅞" tubingless completions. Artificial lift in a 2⅞" tubingless completion is almost universally limited to gas lift or free pistons. Thus, tubingless completions are typically used in shallow to moderately deep wells that are believed, at the time a completion decision is made, to produce all or mostly gas, i.e. no more liquid than can be produced along with the gas.

Gas wells reach their economic limit for a variety of reasons. A very common reason is the gas production declines to a point where the formation liquids are not readily moved up the production string to the surface. Two phase upward flow in a well is a complicated affair and most engineering equations thought to predict flow are only rough estimates of what is actually occurring. One reason is the changing relation of the liquid and of the gas flowing upwardly in the well. At times of more-or-less constant flow, the liquid acts as an upwardly moving film on the inside of the flow string while the gas flows in a central path on the inside of the liquid film. The gas flows much faster than the liquid film. When the volume of gas flow slows down below some critical value, or stops, the liquid runs down the inside of the flow string and accumulates in the bottom of the well.

If sufficient liquid accumulates in the bottom of the well, the well is no longer able to flow because the pressure in the reservoir is not able to start flowing against the pressure of the liquid column. The well is said to have loaded up and died. Years ago, gas wells were plugged much quicker than today because it was not economic to artificially lift small quantities of liquid from a gas well. At relatively high gas prices, it is economic to keep old gas wells on production. It has gradually been realized that gas wells have a life cycle that includes an old age segment where a variety of techniques are used to keep liquids flowing upwardly in the well and thereby prevent the well from loading up and dying.

There are many techniques for keeping old gas wells flowing and the appropriate one depends on where the well is in its life cycle. For example, the first technique is to drop soap sticks into the well. The soap sticks and some agitation cause the liquids to foam. The well is then turned to the atmosphere and a great deal of foamed liquid is discharged from the well. Later in its life cycle, when soaping the well has become much less effective, a string of 1" or 1 ½" tubing is run inside the production string. The idea is that the upward velocity in the small tubing string is much higher which keeps the liquid moving upwardly in the well to the surface. A rule of thumb is that wells producing enough gas to have an upward velocity in excess of 10'/second will stay unloaded. Wells where the upward velocity is less than 5'/second will always load up and die.

At some stage in the life of a gas well, these techniques no longer work and the only approach left to keep the well on production is to artificially lift the liquid with a pump of some description. The logical and time tested technique is to pump the accumulated liquid up the tubing string with a sucker rod pump and allow produced gas to flow up the annulus between the tubing string and the casing string. This is normally not practical in a 2 ⅞" tubingless completion unless one tries to use hollow rods and pump up the rods, which normally doesn't work very well or very long. Even then, it is not long before the rods cut a hole in the 2 ⅞" string and the well is lost. In addition, sucker rod pumps require a large initial capital outlay and either require electrical service or elaborate equipment to restart the engine.

Free pistons or plunger lifts are another common type of artificial pumping system to raise liquid from a well that produces a substantial quantity of gas. Conventional plunger lift systems comprise a piston that is dropped into the well by stopping upward flow in the well, as by closing the wing valve on the well head. The piston is often called a free piston because it is not attached to a sucker rod string or other mechanism to pull the piston to the surface. When the piston reaches the bottom of the well, it falls into the liquid in the bottom of the well and ultimately into contact with a bumper spring, normally seated in a collar or resting on a collar stop. The wing valve is opened and gas flowing into the well pushes the piston upwardly toward the surface, pushing liquid on top of the piston to the surface. Although plunger lifts are commonly used devices, there is more art than science to their operation.

A major disadvantage of conventional plunger lifts is the well must be shut in so the piston is able to fall to the bottom of the well. Because wells in need of artificial lifting are susceptible to being easily killed, stopping flow in the well has a number of serious effects. Most importantly, the liquid on the inside of the production string falls to the bottom of the well, or is pushed downwardly by the falling piston. This is manifestly the last thing that is desired because it is the reason that wells die. In response to the desire to keep the well flowing when a plunger lift piston is dropped into the well, attempts have been made to provide valved bypasses through the piston which open and close at appropriate times. Such devices are to date quite intricate and these attempts have so far failed to gain wide acceptance.

Disclosures of some interest relative to this invention are U.S. Pat. Nos. 2,074,912 and 3,090,316.

SUMMARY OF THE INVENTION

Co-pending application Ser. No. 09/312,737 discloses a plunger lift with a multipart piston. Although this system has worked surprisingly well, it is possible to improve the efficiency, reliability and durability of a multipart piston of a plunger lift.

In this invention, a multipart piston includes a ball and a sleeve that are independently allowed to fall inside the production string toward the productive formation. The cross-sectional area of the ball and sleeve are such that upward flow of gas is substantially unimpeded and the pieces fall through an upwardly moving stream of gas and liquid. Thus, the piston of this invention is normally dropped into a well while it is flowing. This has a great advantage because the liquid in a film on the inside of the production string does not fall into the bottom of the well.

When the ball nears the bottom of the well, it falls into any liquid near the bottom of the well and contacts a bumper assembly which cushions the impact of the device. Ideally, the plunger lift is being dropped frequently enough so there is no liquid column in the bottom of the well so the ball falls directly on the bumper assembly. In this invention, the bumper assembly includes a spring having coils that open upwardly to receive the ball, i.e. there is no anvil for the ball to contact. When the sleeve reaches the ball, they unite into a single component that has a cross-sectional area comparable to existing plunger lift pistons, i.e. any gas entering the production string from the formation is under the piston and pushes it upwardly, thereby pushing any liquid upwardly in the well to the surface.

The sleeve provides a central passage through which the gas flows as the sleeve falls in the well. The ball is sized to close the central passage and provides a second piece of the piston. The flow passage around the ball is on the outside as the it falls in the well. A ball appears to be an ideal shape for one of the components of a two part piston of a plunger lift because repeated impacts are not concentrated in any one location so wear is spread around.

When the united components reach the well head at the surface, a decoupler separates the sleeve from the ball in much the same manner as that disclosed in co-pending application Ser. No. 09/312,737. The ball accordingly immediately falls toward the bottom of the well. Conveniently, a catcher holds the sleeve and then releases the sleeve after the ball is already on the way to the bottom or after a delay period that is used to control the cycle rate of the plunger lift.

Plunger lift pistons of this invention made of conventional steels have proved quite successful in most wells. Some wells present such a difficult problem that the pistons have worn more quickly than desired. An analysis of the problem suggests that, in these difficult wells, the ball and sleeve are reaching the bottom of the well when there is no liquid column in the well, i.e. all of the liquid is in a film flowing upwardly on the inside of the production string. Because the ball and sleeve are reaching the bottom when there is no liquid in the well, they are travelling at high speeds. The force acting on either the ball or the sleeve is the mass of the element multiplied by the square of its velocity. From a production standpoint, it is desirable that no liquid column build up in the bottom of the well but this is not desirable from the standpoint of providing a long lived plunger piston.

One aspect of this invention is to provide a lighter sleeve and piston which reduces the applied force when the element reaches the bottom of the well. Because the sleeve and piston have to have substantial strength, aluminum alloys have proved unsuccessful. Sleeves and balls made of titanium alloys have proved much lighter than steel components and have proved to be much longer lived in use.

It is an object of this invention to provide an improved plunger lift and more particularly an improved two part plunger piston.

A more specific object of this invention is to provide a multipart piston for a plunger lift including a ball which is dropped first into the well and a sleeve sized to receive and unite with the ball near the bottom of the well and then move upwardly as a unit to move liquids toward the surface.

A further object of this invention is to provide a plunger lift piston made of a titanium alloy.

These and other objects of this invention will become more fully apparent as this description proceeds, reference being made to the accompanying drawings and appended claims.

DETAILED DESCRIPTION

Figure 1:
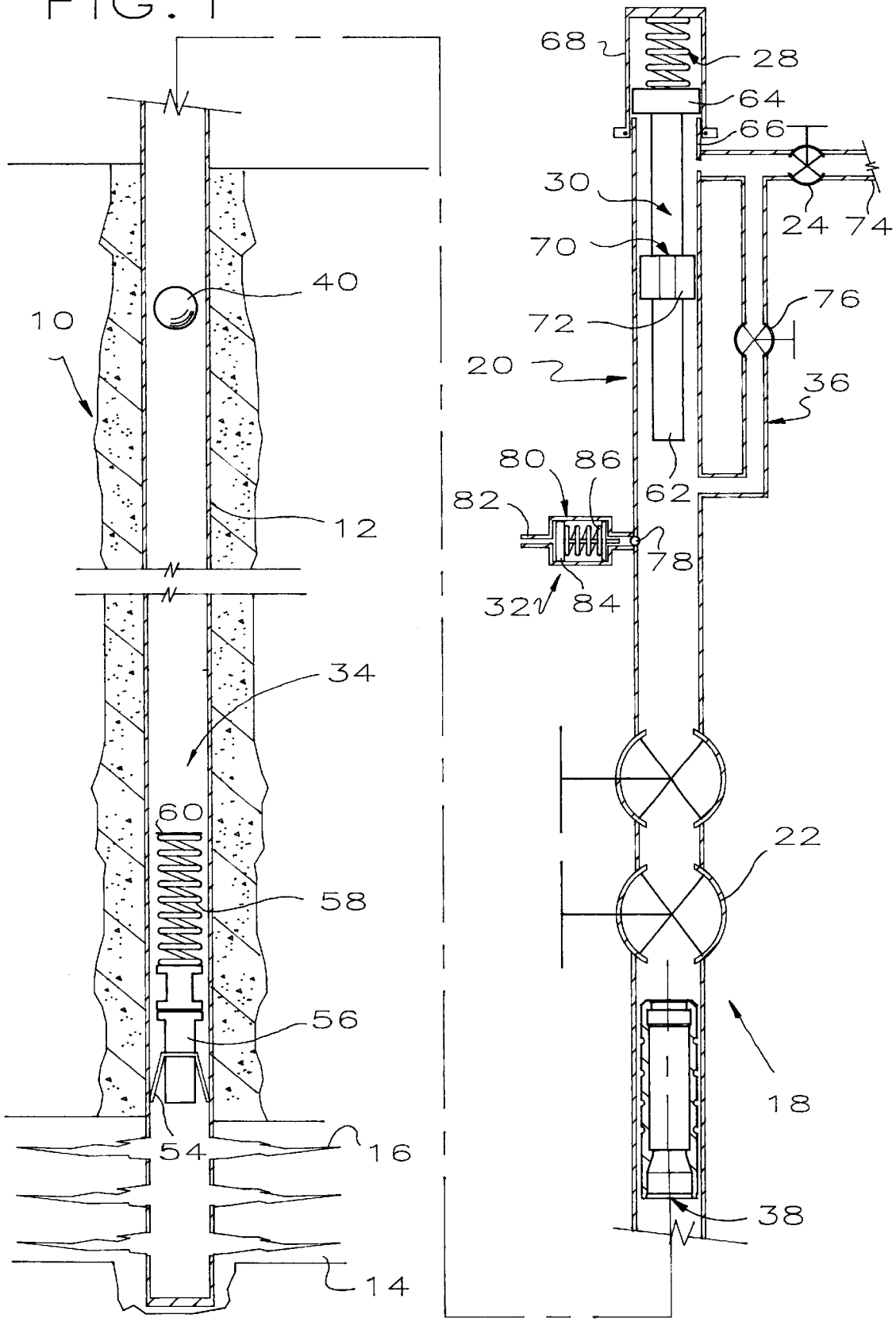
FIG. 1 is a schematic view of a well equipped with a plunger lift system of this invention.
Figure 2:
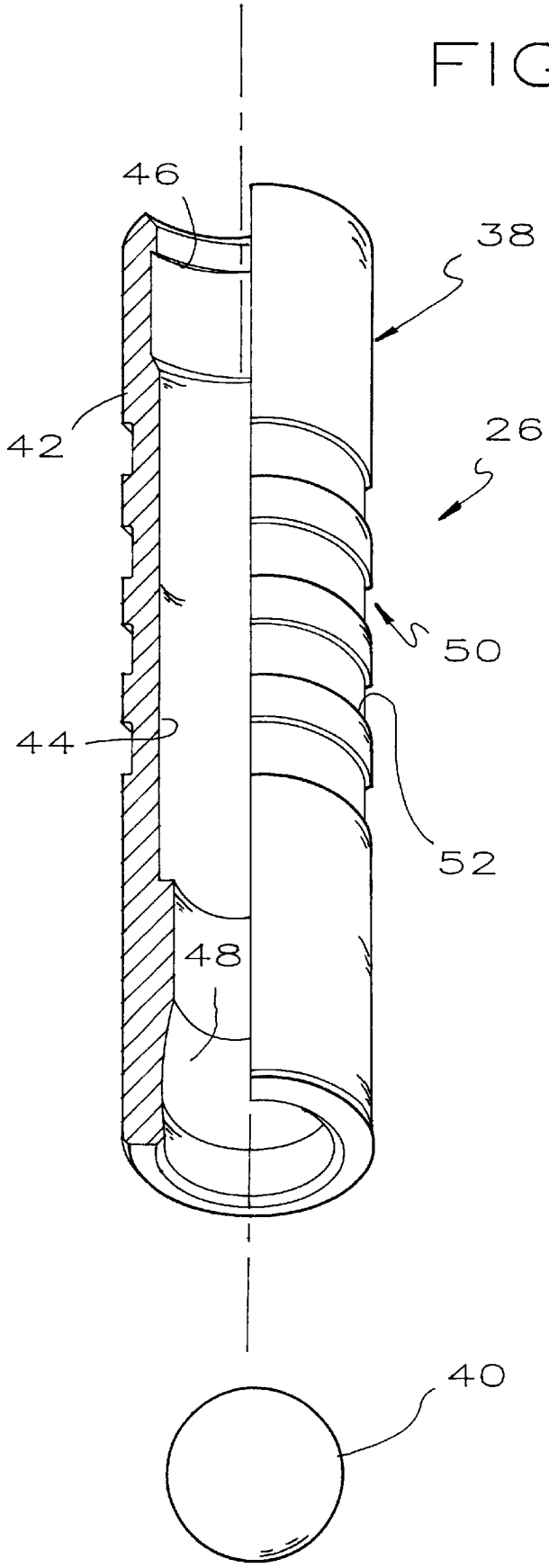
FIG. 2 is an exploded isometric view of the piston of this invention, partly in section, showing the sleeve and ball.

Referring to FIGS. 1–2, a hydrocarbon well 10 comprises a production string 12 extending into the earth in communication with a subterranean hydrocarbon bearing formation 14. The production string 12 is typically a conventional tubing string made up of joints of tubing that are threaded together. Although the production string 12 may be inside a casing string (not shown), it is illustrated as cemented in the earth. The formation 14 communicates with the inside of the production string 12 through perforations 16. As will be more fully apparent hereinafter, the plunger lift 18 may be used to lift oil, condensate or water from the bottom of the well 10 which may be classified as either an oil well or a gas well.

In a typical application of this invention, the well 10 is a gas well that produces some formation liquid. In an earlier stage of the productive life of the well 10, there is sufficient gas being produced to deliver the formation liquids to the surface. The well 10 is equipped with a conventional well head assembly 20 comprising a pair of master valves 22 and a wing valve 24 delivering produced formation products to a surface facility for separating, measuring and treating the produced products.

The plunger lift 18 of this invention comprises, as major components, a piston 26, an upper bumper 28, a decoupler 30, a catcher assembly 32, a lower bumper assembly 34 and a bypass 36 around the piston 26 when it is its uppermost position in the well head assembly 20.

The piston 26 is of unusual design and is made in two pieces comprising an upper sleeve 38 and a ball 40. The sleeve 38 comprises a tubular body 42 having a central passage 44, a fishing lip 46 at the upper end thereof and an annular seating surface 48 at the lower end thereof sized to closely receive the ball 40. In other words, the seating surface 48 is generally hemispherical and has a radius of curvature matching that of the ball 40. The seating surface 48 is preferably recessed or nested into the sleeve 38 so that a portion of the ball 40 projects beyond the end of the sleeve 38. The main reason is that when the sleeve 38 contacts the ball 40 at the bottom of the well, the ball 40 prevents the sleeve 38 from contacting the bumper spring and either damaging the sleeve 38 or the bumper spring. Preferably, about 20–25% of the ball diameter projects below the sleeve 38.

The exterior of the sleeve 38 provides a seal arrangement 50 to minimize liquid on the outside of the sleeve 38 from bypassing around the exterior of the sleeve 38. The seal arrangement 50 may be of any suitable type, such as wire wound around the sleeve 38 providing a multiplicity of bristles or the like or may comprise a series of simple grooves or indentations 52. The grooves 52 work because they create a turbulent zone between the sleeve 38 and the inside of the production string 12 thereby restricting liquid flow on the outside of the sleeve 38. The grooves 52 are also used as a catch area for a retriever to hold the sleeve 38 at a well head, as will be more fully apparent hereinafter.

The ball 40 is has a radius of curvature matching the seating surface 48 and is, of course, of elegant simplicity. By suitably machining the ball 40 and surface 48, no resilient seals or additional seals of any type are necessary. In one practical embodiment of the invention, the ball may be of polished chrome steel having a Rockwell hardness of 48–52. The seating surface 48 is machined to a clean finish but preferably no special surface preparation is done. After a few impacts with the ball 40, the seating surface 48 assumes a desirable surface finish.

As will be more fully apparent hereinafter, the ball 40 is first dropped into the well 10, followed by the sleeve 38. The ball 40 and sleeve 38 accordingly fall separately and independently into the well 10, usually while the well 10 is producing gas and liquid up the production string 12 and through the well head assembly 20. By separately, it is meant that the ball 40 and sleeve 38 are not connected. By independently, it is meant that the ball 48 and sleeve 38 are capable of moving independently of one another even if they are tethered together in some fashion. When the ball 40 and sleeve 38 reach the bottom of the well, they nest together in preparation for moving upwardly.

In one aspect, the sleeve 38 and ball 40 each have a flow bypass so they separately fall easily into the well 10 even when there is substantial upward flow in the production string 12. When they reach the bottom of the well, they unite into a single component which substantially closes the flow bypasses, or at least restricts them, so gas entering through the perforations 16 pushes the piston 26 upwardly in the well and thereby pushes liquid, above the piston 26, upwardly toward the well head assembly 20.

Looked at in another perspective, the sleeve 38 and ball 40 each have a surface area which is selected so that they separately fall easily in the well but, when they are united into the piston 26, the piston 26 is pushed upwardly in the well thereby pushing any liquid upwardly toward the well head assembly 20. The selection of the surface areas of the sleeve 38 and ball 40 is preferably done so that a given pressure differential will move the ball 40 before moving the sleeve 38. In other words, the ball 40 is easier to move than the sleeve 38. The reason is that is if the ball 40 can be constructed so it always pushes from below, there is no tendency for the sleeve 38 to separate from the ball 40 during upward movement in the well 10.

The upper bumper 28 is of conventional design and comprises a helical spring. Bumpers of this type are well known in the plunger lift art and are commercially available.

The lower bumper assembly 34 sits, or is part of, a conventional collar stop 54 that is supported in the gap provided by couplings between adjacent joints of the production string 12. In a well (not shown) having a tubing string inside a casing string cemented in the earth, the lower bumper assembly 34 typically sits in a seating nipple (not shown) in the tubing string. The lower bumper assembly 34 includes a body 56 and a relatively long, preferably helical, spring 58 open at the top, i.e. without any anvil so the spring 58 provides an opening to receive, or partially receive the ball 40. Because the ball 40 falls into the bottom of the well 10 when it is flowing, there is little or no liquid accumulated adjacent the formation 14. Thus, the ball 40 tends to strike the lower bumper 34 at higher velocities than conventional plunger pistons. For this reason,. a longer, softer bumper spring is desired. Because the spring 58 is open upwardly, the ball 40 tends to be received in the open upper coil 60 so the ball 40 tends to drop into the spring 58 and does not repeatedly bounce off and rebang the spring 58, as would occur if the ball 40 were to strike an anvil.

The decoupler 30 acts to separate the piston 26 when it reaches the well head assembly 20. The decoupler 30 comprises a rod 62 sized to pass into the top of the sleeve 38 and is fixed to a piston 64. The piston 64 is larger than a conduit 66 in which the rod 62 reciprocates and is thus prevented from falling into the well 10. The top of the well head assembly 20 is closed with a screw cap 68. A stop 70 on the rod 62 limits upward movement of the sleeve 38. A series of grooves 72 allow formation products to pass around the stop 70 and into a flow line 74 connected to the wing valve 24. It will be seen that the piston 26 moves upwardly in the well 10 as one piece. When the sleeve 38 passes onto the end of the rod 62, the rod 62 ultimately contacts the top of the ball 40, stopping upward movement of the ball 40 and allowing continued upward movement of the sleeve 38. The end of the rod 62, below the stop 70 is longer than the passage 44 so the ball 40 is pushed out of the sleeve 38 thereby releasing the ball 40 which falls toward the bottom of the well 10.

The bypass 36 helps prevent the piston 26 from sticking in the. well head assembly 20 and may include a valve 76. The bypass 36 opens into the well head assembly 20 below the bottom of the sleeve 38 when it is in its uppermost position in the well head assembly 20. Thus, there will be a tendency of gas flowing through the well head assembly 20 to move through the bypass 36 rather than pinning the sleeve 38 against the stop 70.

A catcher 32 may be provided to latch onto the sleeve 38 and thereby hold it for a while to provide a delay period between successive cycles of the piston 26 in an attempt to match the cycle rate of the piston 26 with the well 10 to remove produced formation liquid as expeditiously as possible and thereby restrict gas production as little as possible. To these ends, grooves 52 of the sleeve 38 are sized to receive a ball detent 78 forced inwardly into the path of the sleeve 38 by an air cylinder 80 connected to a supply of compressed gas (not shown) through a fitting 82. A piston 84 in the cylinder 80 is biased by a spring 86 to a position releasing the ball detent 78 for movement out of engagement with one of the slots 52. Pressure is normally applied to the cylinder 80 thereby forcing the ball detent 78 into the path of travel of the sleeve 38. Upon a signal from a controller (not shown), gas pressure is bled from the cylinder..80 allowing the spring 86 to retract the piston 84 and allowing the weight of the sleeve 38 to push the ball detent 78 out of the slot 52 thereby releasing the sleeve 38 for movement downwardly into the well 10.

When it is desired to retrieve the ball 40 or the piston 26, the decoupler 30 is replaced with a similar device having a stop 70 but eliminating the rod 62. This causes the piston 26 to impact the bumper 28 without dislodging the ball 40. The piston 26 is held in its upward position by the flow of formation products around the piston 26 in conjunction with the catcher 32 which latches onto the sleeve 38.

Operation of the plunger lift 18 of this invention should now be apparent. The ball 40 is first dropped into the well 10. It falls rapidly through a rising stream of produced products onto the bumper assembly 34 which substantially cushions the impact and minimizes damage to the ball 40 to a large extent because the top of the spring 58 is open. When the sleeve 38 is released by the catcher 32, it falls through the well 10 to the bottom. Because ball 40 easily enters the bottom opening of the sleeve 38, the ball 40 and sleeve 38 easily unite with the ball 40 sealing against the seating member 80. The combined downwardly surface area of the sleeve 38 and ball 40, in their united configuration, is sufficient to allow gaseous products from the formation 14 to push the piston 26, and any liquid above it, upwardly to the well head assembly 20.

As the piston 26 approaches the well head assembly 20, a slug of liquid passes through the wing valve 24 into the flow line 74 toward a surface treatment facility. The sleeve 38 passes over the rod 62 which stops upward movement of the ball 40 thereby releasing the ball 40 which drops into the well 10 in the start of another cycle. The sleeve 38 is retained by the catcher 32 for a period of time depending on the requirements of the well 10. If the well 10 needs to be cycled as often as possible, the delay provided by the catcher 30 is only long enough to be sure the ball 40 will reach the bottom of the well 10 before the sleeve 38. In more normal situations, the sleeve 38 will be retained on the catcher 30 so the piston 26 cycles much less often.

A prototype of this invention has been tested. In a 5400' gas well that loads up and dies with produced liquid, it took six and one half minutes to make a round trip from the surface to 5400' and return to the surface bringing approximately ¼ barrel of gas cut liquid. A delay of forty five minutes between dropping the sleeve 38 kept the well unloaded. Between plunger trips, the well produced 310 MCF per day.

Pistons 26 having a chrome steel ball 40 and a sleeve 38 made of 4140 heat treated steel have proved quite successful in a wide variety of applications. Wells having very low bottom hole flowing pressures, e.g. 75 psi, present an unusually tough situation for any type plunger lift for a variety of reasons, almost all of which relate to the fact that very little liquid will kill the well, often in a way that is not readily apparent.

For purposes of illustration, it is assumed that a well has a 75 psi bottom hole flowing pressure and fifty feet of liquid in the bottom of the hole above the perforations when the plunger piston arrives. Using a normal plunger lift will kill the well because shutting the well in to drop the piston will cause the liquid flowing up the production string as a film on the inside of the tubing string to fall to the bottom, producing a liquid column sufficient to kill the well. In a two part plunger system of this invention, or as disclosed in co-pending application Ser. No. 09/312,737, the sleeve 38 may shear some of the liquid film off the inside of the production string and cause it to fall or be pushed by the sleeve 38 toward the bottom of the well. When the sleeve 38 arrives at the bottom of the well 10, unites with the ball 40 and starts up the hole in response to bottom hole flowing pressure under the piston 26, it starts lifting the original liquid column plus any liquid that has been sheared off during downward movement of the sleeve 38 plus any liquid that is picked up during upward movement of the piston. The liquid that is picked up during upward movement of the piston may be substantial because, as the piston starts upwardly, the gas velocity above the piston falls to almost zero thereby allowing the film of liquid on the inside of the production string to fall to the top of the piston. Because the bottom hole flowing pressure is so low, it is easy to collect enough liquid above the piston 26, when it is moving, to slow down and stop the piston 26. When this occurs, the piston 26 ultimately falls to the bottom of the well 10 and the well 10 is dead.

Thus, shearing liquid off the upwardly flowing film during downward and then upward movement of the sleeve 38 creates an additional liquid load for the piston 26. Recognizing this, among other things, leads one to cycle the piston 26 much more frequently to keep the production string 12 as free of liquid as possible. This means the ball 40 and sleeve 38 are prone to arrive at the bottom of the well 10 when there is no liquid column covering the bumper assembly 34. Because any liquid column slows down the fall of the ball 40 and sleeve 38, this means the ball 40 and sleeve 38 are falling at a very rapid rate when contacting the bumper spring 58.

The force delivered by, and to, the ball 40 and/or sleeve 38 is equal to the mass of the ball 40 and/or sleeve 38 multiplied by the square of the velocity when they impact the spring 58. Thus, lightening the ball 40 and/or sleeve 38 reduces the impact forces acting on the bumper assembly 34, the ball 40 and the sleeve 38. Manifestly, the ball 40 and sleeve 38 have to be strong to withstand such impact forces, particularly when they are repeated a number of times per hour. Aluminum alloys have not proved successful even though they are much lighter than steel but they are too soft and deform too easily.

It has been found that making the ball 40 and/or the sleeve 38 of titanium alloys provides desirably low weight to minimize impact forces and desirably high strength to withstand the impact forces generated during operation. Although densities of titanium alloys are not widely available in the literature, the published density of titanium is 0.16 pounds/cubic inch. Titanium alloys used in this invention have densities less than about 0.25 pounds/cubic inch. Light weight sleeves 38 and light weight balls 40 are important because they reduce the impact forces occurring when the balls 40 and sleeves 38 collide at the bottom of the well as will be more fully apparent hereinafter.

Because the requirement is for high strength and low weight, which is characteristic of titanium alloys, there are many titanium alloys that are operable in this invention. The important strength characteristic is thought to be strength in compression. Compressive strengths of titanium alloys are not easy to determine from the literature or from suppliers but it is thought that tensile strengths are a proxy for compressive strengths in the sense that compressive strengths are of similar magnitude as tensile strengths and compressive strengths rise as tensile strengths rise. For use in this invention, a titanium alloy should have a tensile strength of at least 90,000 psi and preferably above 115,000 psi. Although there are many titanium alloys that fit this description, one that has proved suitable is called 6AL4V titanium, meaning that it contains about 6% aluminum and 4% vanadium with minor amounts of other metals. A plunger piston of this invention has proved to operate trouble free in very low flowing pressure wells for a number of months where steel sleeves and balls have been damaged beyond use within a short time from repeated impacts with the bumper assembly 34.

Another suitable material for the ball 40 is silicon nitride which is a proven material used in ball check valves. Silicon nitride balls are very durable and somewhat lighter than titanium alloys.

One unusual aspect of titanium plungers of this invention is they take longer to cycle than substantially identical steel plungers. For example, a well equipped with a steel plunger might cycle in seven minutes, i.e. from the time the sleeve 38 is dropped until the plunger 26 reappears at the well head 20. Equipping the well with a titanium plunger increases the cycle significantly, for example, to nine minutes. It is believed that the time increase does not occur during upward movement of the plunger 26 in the well but occurs during downward movement of the sleeve 38 and ball 40. Without being bound by any particular theory, this is believed to occur because of the interaction of upwardly flowing gas and upwardly flowing liquid on the light weight sleeve 38 and light weight ball 40. This is important because it means that a titanium sleeve 38 and light weight ball 40 do not travel as fast downwardly in the well as a comparable steel sleeve 38. This is important because the force applied to the sleeve 38 and/or the ball 40 is proportional to the mass of the element multiplied by the square of its velocity. By using a strong, light weight sleeve 38 and ball 40, the impact forces between them and the bumper spring 58 is much reduced.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A plunger lift for a well producing through a production string communicating with a hydrocarbon formation, comprising a free piston having at least two sections, movable independently downwardly in the well, the sections comprising a ball and a sleeve providing a smooth rigid seating surface for receiving the ball so the ball and sleeve join together in the well for pushing liquid, above the piston, upwardly, the ball being freely movable into and out of the sleeve, the ball and sleeve being free of an assembly to resist movement of the ball out of the sleeve.

2. The plunger lift of claim 1 wherein the sleeve is made of a titanium alloy having a tensile strength of at least 90,000 psi and the ball is made of a material selected from the group consisting essentially of silicon nitride and titanium alloys having a tensile strength of at least 90,000 psi.

3. The plunger lift of claim 2 wherein the titanium alloy and the silicon nitride have a density less than about 0.25 pounds/cubic inch.

4. The plunger lift of claim 1 wherein the sleeve comprises an upper section having an upper end and an open lower end providing the smooth rigid seating surface, the seating surface comprising an annular hemispherical seating surface sized to receive the ball.

5. The plunger lift of claim 4 wherein the sleeve provides a central passage opening through the hemispherical seating surface and the ball provides a valve element cooperating with the seating surface to provide a metal-to-metal seal to prevent substantial quantity of formation products from flowing inside the central passage when the ball engages the seating surface.

6. The plunger lift of claim 5 wherein the seating surface is recessed inside the sleeve and, when the ball engages the seating surface, an outer surface of the ball projects beyond an end of the seating surface.

7. The plunger lift of claim 1 wherein the ball nests in the sleeve when the ball and sleeve are joined together in the well.

8. A method of lifting liquids from a well producing hydrocarbons from a formation with a plunger lift having a multipart piston made of a material having a density less than about 0.25 pounds/cubic inch selected from the group consisting essentially of silicon nitride and titanium alloys having a tensile strength of at least 90,000 psi, comprising placing a bumper assembly in the well adjacent the formation;

moving upper and lower sections together upwardly into the well head and capturing the upper section at a location adjacent the well head;

dropping the lower section in the well, pausing for a time period and then, after the lower section is travelling downwardly in the well, releasing the upper section and allowing it to drop into the well;

uniting the upper and lower sections into a unit near the formation and moving the unit upwardly in the well in response to formation gases passing into the well and thereby pushing liquid upwardly with the piston.

9. The method of claim 8 wherein the dropping steps occur when gas is flowing upwardly in the well.

10. The method of claim 8 wherein the well includes a well head and wherein the dropping steps occur when gas is flowing upwardly in the well and exiting through the well head.

11. The method of claim 8 wherein the step of dropping the upper section into the well comprises dropping the upper section into the well at a time when there is substantially no liquid column adjacent the bumper assembly.

12. A method of lifting liquids from a well producing hydrocarbons from a formation through a well head with a plunger lift having a multipart piston having at least one upper section and one lower section, movable independently downwardly in the well, the sections comprising a ball and a sleeve providing a seating surface for receiving the ball so the ball and sleeve join together in the well for pushing liquid, above the piston, upwardly, comprising moving the upper and lower sections together upwardly and capturing the upper section at a location adjacent the well head;

dropping the lower section in the well, pausing for a time period and then, after the lower section is travelling downwardly in the well, releasing the upper section and allowing it to drop into the well;

uniting the upper and lower sections into a unit near the formation and moving the unit upwardly in the well in response to formation gases passing into the well and thereby pushing liquid upwardly with the piston.

13. The method of claim 12 wherein the dropping steps occur when gas is flowing upwardly in the well.

14. The method of claim 12 wherein the lower section is the ball and dropping the lower section comprises dropping the ball and the upper section is the sleeve and dropping the upper section comprises dropping the sleeve.

15. A method of lifting liquids from a well producing hydrocarbons from a formation through a well head with a plunger lift having a multipart piston having at least one upper section and one lower section, movable independently downwardly in the well, the sections comprising a ball and a sleeve providing a seating surface for receiving the ball so the ball and sleeve join together in the well for pushing liquid, above the piston, upwardly, comprising moving the ball and sleeve upwardly together to a location adjacent the well head and pushing liquid upwardly through the well;

separating the ball from the sleeve at a location adjacent the well head and thereby dropping the ball into the well and, after a time period and after the ball is travelling downwardly in the well, dropping the sleeve in the well; and uniting the ball and sleeve into a unit near the formation and moving the unit upwardly in the well in response to formation gases passing into the well and thereby pushing liquid upwardly with the piston.

16. The method of claim 15 wherein the dropping steps occur when gas is flowing upwardly in the well.

17. The method of claim 15 wherein the upper section comprises the sleeve and the lower section comprises the ball and wherein the separating step comprises moving the sleeve upwardly around a downwardly extending elongate member for pushing the ball out of the sleeve as the sleeve moves upwardly.

* * * * *

US006467541C1

(12) EX PARTE REEXAMINATION CERTIFICATE (6841st)

United States Patent

Wells

(10) Number: US 6,467,541 C1

(45) Certificate Issued: May 26, 2009

(54) PLUNGER LIFT METHOD AND APPARATUS

(75) Inventor: Edward A. Wells, Corpus Christi, TX (US)

(73) Assignee: MGM Well Service, Inc., Corpus Christi, TX (US)

Reexamination Request:
No. 90/007,598, Jun. 22, 2005

Reexamination Certificate for:

| | |
|---|---|
| Patent No.: | **6,467,541** |
| Issued: | **Oct. 22, 2002** |
| Appl. No.: | **09/630,255** |
| Filed: | **Aug. 1, 2000** |

Related U.S. Application Data

(63) Continuation-in-part of application No. 09/312,737, filed on May 14, 1999, now Pat. No. 6,209,637.

(51) Int. Cl.

| | |
|---|---|
| ***F04B 47/00*** | (2006.01) |
| ***F04B 47/12*** | (2006.01) |
| ***E21B 43/12*** | (2006.01) |
| ***E21B 43/00*** | (2006.01) |

(52) U.S. Cl. ..... 166/153; 166/372

(58) Field of Classification Search ..... None
See application file for complete search history.

(56) References Cited

U.S. PATENT DOCUMENTS

| | | | | |
|---|---|---|---|---|
| 971,612 | A | 10/1910 | Holliday | |
| 1,769,637 | A | 7/1930 | Fletcher et al. | |
| 1,784,096 | A | 12/1930 | Fletcher | |
| 1,819,994 | A | 8/1931 | Claytor | |
| 1,833,778 | A | 11/1931 | Fletcher | |
| 1,836,842 | A | 12/1931 | Fletcher | |
| 1,836,843 | A | 12/1931 | Fletcher | |
| 1,836,871 | A | 12/1931 | Ricker | |
| 1,836,912 | A | 12/1931 | Fletcher | |
| 1,844,074 | A | 2/1932 | Ricker | |
| 1,896,232 | A | 2/1933 | Fletcher | |
| 1,905,058 | A | 4/1933 | Ricker | |
| 1,919,547 | A | 7/1933 | Fletcher | |
| 1,922,396 | A | 8/1933 | Ricker | 103/52 |
| 1,932,451 | A | 10/1933 | Evans | 103/52 |
| 1,947,587 | A | 2/1934 | Fletcher | 103/52 |
| 1,989,035 | A | 1/1935 | Blum | 166/18 |

(Continued)

FOREIGN PATENT DOCUMENTS

| | | |
|---|---|---|
| SU | 176541 | 11/1965 |
| SU | 182634 | 6/1966 |
| SU | 188423 | 11/1966 |
| SU | 171351 | 5/1969 |
| SU | 596710 | 3/1978 |
| SU | 791939 | 12/1980 |
| SU | 171351 | 2/1981 |

OTHER PUBLICATIONS

Halliday et al., Fundamentals of Physics—Part 1, Copyright 1997 , John Wiley & Sons Inc., Fifth Edition, pp. 113–115.*

I. Shulyatikov et al., Removing Liquid from Gas Wells by "Well Shuttles," Corrosion & Prevention 2001, Sep. 29–Oct. 2, 2002, Orlando, Fla.

A.A. Popov, Experience in Introducing Plunger Lift at Fields of the Ukhta Complex, Gazovoe delo, No. 9, at 23–26 (1968).

B.V. Panasov & I.F. Firsov, Some Results of Plunger Lift Use at the Saushinsk Gas Field, Gazovoe delo, No. 7, at 18–21 (1969).

*Primary Examiner*—David O. Reip

(57) ABSTRACT

A plunger lift for a hydrocarbon well includes a multipart piston that is dropped into the well in separate pieces. When the pieces reach the bottom of the well, they fall into an accumulation of the formation liquid in the bottom of the well and unite. Gas from the formation pushes the unit upwardly, pushing liquid above the piston toward the surface. In one embodiment, the piston is made of a low density, high strength material such as silicon nitride and/or titanium alloys.

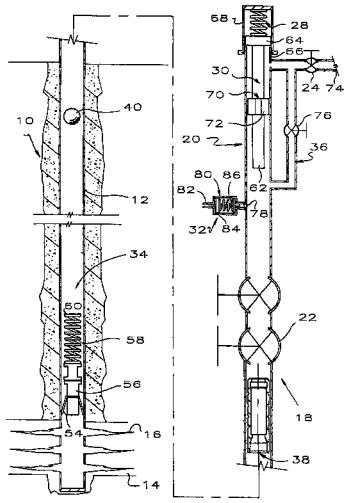

U.S. PATENT DOCUMENTS

| | | | | | |
|---|---|---|---|---|---|
| 1,993,258 | A | | 3/1935 | Bettis | 103/52 |
| 1,993,266 | A | | 3/1935 | Evans | 103/52 |
| 1,993,292 | A | | 3/1935 | Woods | 103/52 |
| 2,001,012 | A | | 5/1935 | Burgher | |
| 2,001,551 | A | | 5/1935 | Scott | 103/52 |
| 2,001,552 | A | | 5/1935 | Scott | 103/52 |
| 2,013,111 | A | | 9/1935 | Scott | 103/52 |
| 2,018,204 | A | | 10/1935 | Evans et al. | 103/52 |
| 2,018,205 | A | | 10/1935 | Evans | 103/52 |
| 2,058,825 | A | | 10/1936 | Rallet et al. | 166/18 |
| 2,074,912 | A | | 3/1937 | Hutto | |
| 2,184,393 | A | | 12/1939 | Luccous | 166/18 |
| 2,237,408 | A | | 4/1941 | Burgher | |
| 2,508,174 | A | | 5/1950 | Knox et al. | 103/52 |
| 2,555,112 | A | | 5/1951 | Brown | 103/52 |
| 2,642,002 | A | | 6/1953 | Knox et al. | 103/52 |
| 2,649,738 | A | | 8/1953 | Tait | 103/52 |
| 2,661,024 | A | | 12/1953 | Knox | 137/692 |
| 2,674,201 | A | | 4/1954 | Talbott | 103/225 |
| 2,674,951 | A | | 4/1954 | Zaba | 103/52 |
| 2,676,547 | A | | 4/1954 | Knox | 103/46 |
| 2,684,633 | A | | 7/1954 | Knox | 103/52 |
| 2,699,121 | A | | 1/1955 | Knox | 103/52 |
| 2,757,614 | A | | 8/1956 | Spalding | 103/52 |
| 2,762,309 | A | | 9/1956 | Knox | 103/52 |
| 2,762,310 | A | | 9/1956 | Eklund | 103/52 |
| 2,789,645 | A | | 4/1957 | Curnutt et al. | 166/170 |
| 2,791,181 | A | | 5/1957 | Know | 103/52 |
| 2,802,535 | A | | 8/1957 | Taylor | 166/170 |
| 2,821,142 | A | | 1/1958 | Knox | 103/52 |
| 2,878,754 | A | | 3/1959 | McMurry | 103/52 |
| 2,884,861 | A | | 5/1959 | Vincent et al. | 103/52 |
| 2,893,493 | A | | 7/1959 | Copas | 166/170 |
| 2,918,015 | A | | 12/1959 | Knox | 103/52 |
| 2,937,598 | A | | 5/1960 | Brown | 103/52 |
| 2,962,978 | A | | 12/1960 | Reeves | 103/225 |
| 2,970,547 | A | | 2/1961 | McMurry | 103/52 |
| 3,012,512 | A | | 12/1961 | Shaw | 103/52 |
| 3,012,513 | A | | 12/1961 | Knox | 103/52 |
| 3,012,832 | A | | 12/1961 | Knox | 309/23 |
| 3,020,852 | A | | 2/1962 | Roach et al. | 103/225 |
| 3,031,971 | A | | 5/1962 | Roach | 103/52 |
| 3,034,581 | A | | 5/1962 | Reynolds | 166/174 |
| 3,037,558 | A | | 6/1962 | McGowen, Jr. et al. | 166/170 |
| 3,039,394 | A | | 6/1962 | Brown et al. | 103/52 |
| 3,055,306 | A | | 9/1962 | Tausch | 103/52 |
| 3,090,315 | A | | 5/1963 | Milton | 103/52 |
| 3,090,316 | A | | 5/1963 | Montgomery | |
| 3,095,819 | A | | 7/1963 | Brown et al. | 103/52 |
| 3,147,808 | A | | 9/1964 | McCarvell et al. | 166/70 |
| 3,150,596 | A | | 9/1964 | Knox | 103/52 |
| 3,171,487 | A | | 3/1965 | Ault | 166/65 |
| 3,176,619 | A | | 4/1965 | Shaw | 103/52 |
| 3,181,470 | A | | 5/1965 | Clingman | 103/52 |
| 3,229,768 | A | | 1/1966 | Lunebring | 166/170 |
| 3,249,056 | A | | 5/1966 | Lyles | 103/52 |
| 3,273,504 | A | | 9/1966 | Lyles | 103/52 |
| 3,304,874 | A | | 2/1967 | Lyles | 103/52 |
| 3,329,211 | A | | 7/1967 | Roach | 166/170 |
| 3,394,763 | A | | 7/1968 | Page, Jr. | 166/170 |
| 3,412,798 | A | | 11/1968 | Gregston | |
| 3,424,066 | A | | 1/1969 | Moore, Jr. | 92/193 |
| 3,424,093 | A | | 1/1969 | Moore, Jr. | 103/52 |
| 3,456,727 | A | | 7/1969 | Nettles | 166/170 |
| 4,007,784 | A | * | 2/1977 | Watson et al. | 166/170 |
| 4,070,134 | A | | 1/1978 | Gramling | 417/56 |
| 4,211,279 | A | | 7/1980 | Isaacks | |
| 4,410,300 | A | | 10/1983 | Yerian | 417/56 |
| 4,417,858 | A | | 11/1983 | Stout | 417/58 |
| 4,629,004 | A | | 12/1986 | Griffin | |
| 4,716,970 | A | | 1/1988 | Henning | |
| 4,921,048 | A | | 5/1990 | Grow | |
| 4,923,011 | A | | 5/1990 | Skipper | |
| 5,012,866 | A | | 5/1991 | Skipper | |
| 5,335,727 | A | | 8/1994 | Cornette | |
| 5,415,227 | A | | 5/1995 | Jennings | |
| 6,045,335 | A | | 4/2000 | Dinning | |
| 6,173,783 | B1 | | 1/2001 | Abbott-Brown | |
| 6,209,637 | B1 | | 4/2001 | Wells | |
| 6,705,404 | B2 | | 3/2004 | Bosley | 166/372 |
| 6,719,060 | B1 | * | 4/2004 | Wells | 166/372 |

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 12–14 is confirmed.

Claims 1–7 are cancelled.

Claims 8, 10 and 15 are determined to be patentable as amended.

Claims 9, 11, 16 and 17, dependent on an amended claim, are determined to be patentable.

8. A method of lifting liquids from a well producing hydrocarbons from a formation *through a well head* with a plunger lift having a multipart piston made of a material having a density less than about 0.25 pounds/cubic inch selected from the group consisting essentially of silicon nitride and titanium alloys having a tensile strength of at least 90,000 psi, comprising placing a bumper assembly in the wall adjacent the formation;

moving upper and lower sections together upwardly into the well head and capturing the upper section at a location adjacent the well head;

dropping the lower section in the well, pausing for a time period and then, after the lower section is travelling downwardly in the well, releasing the upper section and allowing it to drop into the well;

uniting the upper and lower sections into a unit near the formation and moving the unit upwardly in the well in response to formation gases passing into the well and thereby pushing liquid upwardly with the piston.

10. The method of claim 8 wherein [the well includes a well head and wherein] the dropping steps occur when gas is flowing upwardly in the well and exiting through the well head.

15. A method of lifting liquids from a well producing hydrocarbons from a formation through a well head with a plunger lift having a multipart piston having at least one upper section and one lower section, movable independently downwardly in the well, the sections comprising a ball and a sleeve providing a seating surface for receiving the ball so the ball and sleeve join together in the well for pushing liquid, above the piston, upwardly, *the sleeve being made of a material having a density less than about 0.25 pounds/cubic inch,* comprising moving the ball and sleeve upwardly together to a location adjacent the well head and pushing liquid upwardly through the well;

separating the ball from the sleeve at a location adjacent the well head and thereby dropping the ball into the well and, after a time period and after the ball is travelling downwardly in the well, dropping the sleeve in the well; and uniting the ball and sleeve into a unit near the formation and moving the unit upwardly in the well in response to formation gases passing into the well and thereby pushing liquid upwardly with the piston.

* * * * *